US008453659B2

(12) United States Patent
Li

(10) Patent No.: US 8,453,659 B2
(45) Date of Patent: Jun. 4, 2013

(54) OUTDOOR AV DISPLAY ARRANGEMENT FOR OUTDOOR SHADING DEVICE

(75) Inventor: Wanda Ying Li, Santa Ana, CA (US)

(73) Assignee: Joen-An Oliver Ma, Arcadia, CA (US)

( * ) Notice: Subject to any disclaimer, the term of this patent is extended or adjusted under 35 U.S.C. 154(b) by 910 days.

(21) Appl. No.: 12/313,493

(22) Filed: Nov. 19, 2008

(65) Prior Publication Data

US 2010/0124039 A1 May 20, 2010

(51) Int. Cl.
*A45B 3/00* (2006.01)

(52) U.S. Cl.
USPC ..... 135/16; 361/679.02; 361/679.21; 361/679.23; 361/679.3; 248/917

(58) Field of Classification Search
USPC ..... 361/679.24
See application file for complete search history.

(56) References Cited

U.S. PATENT DOCUMENTS 4,684,230 A * 8/1987 Smith ..... 396/428
D341,831 S * 11/1993 Mozdzanowski ..... D14/168
5,273,062 A * 12/1993 Mozdzanowski ..... 135/16
5,275,364 A * 1/1994 Burger et al. ..... 248/125.1
5,321,579 A * 6/1994 Brown et al. ..... 361/679.06
5,683,064 A * 11/1997 Copeland et al. ..... 248/278.1
5,683,070 A * 11/1997 Seed ..... 248/442.2
6,017,188 A * 1/2000 Benton ..... 416/5
6,134,103 A * 10/2000 Ghanma ..... 361/679.05
6,138,970 A * 10/2000 Sohrt et al. ..... 248/278.1
6,158,701 A * 12/2000 Deshler ..... 248/127
6,412,889 B1 * 7/2002 Hummell et al. ..... 312/9.53
6,519,144 B1 * 2/2003 Henrie et al. ..... 361/679.43
6,636,918 B1 * 10/2003 Aguilar et al. ..... 710/303
6,765,789 B2 * 7/2004 Yang ..... 361/679.45
6,961,237 B2 * 11/2005 Dickie ..... 361/679.04
7,017,598 B2 * 3/2006 Nipke ..... 135/16
7,034,902 B2 * 4/2006 Tajima ..... 348/836
7,143,601 B1 * 12/2006 Jimenez ..... 62/457.7
D580,421 S * 11/2008 Sculler et al. ..... D14/239
7,559,520 B2 * 7/2009 Quijano et al. ..... 248/309.1
7,593,220 B2 * 9/2009 Proctor et al. ..... 361/679.23
7,604,015 B2 * 10/2009 Fraser ..... 135/31
7,650,230 B1 * 1/2010 Laverick et al. ..... 701/200
7,778,624 B2 * 8/2010 Li ..... 455/344
2001/0001083 A1 * 5/2001 Helot ..... 439/131
2004/0240167 A1 * 12/2004 Ledbetter et al. ..... 361/683
2005/0161067 A1 * 7/2005 Hollins ..... 135/16
2006/0127034 A1 * 6/2006 Brooking et al. ..... 386/46
2007/0070588 A1 * 3/2007 Lin ..... 361/681
2007/0242450 A1 * 10/2007 Blatecky ..... 362/102
2007/0279856 A1 * 12/2007 Bragg ..... 361/683
2009/0071516 A1 * 3/2009 Li ..... 135/16
2011/0157801 A1 * 6/2011 Satterfield ..... 361/679.01

* cited by examiner

*Primary Examiner* — Anthony Q Edwards
(74) *Attorney, Agent, or Firm* — Raymond Y. Chan; David and Raymond Patent Firm

(57) ABSTRACT

The outdoor shading device includes a supporting frame, an awning frame, and an outdoor AV (Audio-Video) display arrangement. The AV display arrangement is coupled with the supporting frame of the outdoor shading device via a supporting arm and is connected with the portable electronic device by a connected unit such that the user is able to enjoy greater visual effects through watching relatively large display in comparison with the portable electric device but without sacrificing a portable controlling functionality of the portable electric device.

20 Claims, 4 Drawing Sheets

OUTDOOR AV DISPLAY ARRANGEMENT FOR OUTDOOR SHADING DEVICE

BACKGROUND OF THE PRESENT INVENTION

1. Field of Invention

The present invention relates to an outdoor shading device, and more particularly to a outdoor AV display arrangement for outdoor shading device, wherein the AV display arrangement is coupled with the supporting frame of the outdoor shading device via a supporting arm and is connected with the portable electronic device by a connected unit such that the user is able to enjoy greater visual effects through watching relatively large display in comparison with the portable electric device without sacrificing a portable controlling functionality of the portable electric device.

2. Description of Related Arts

Outdoor shading devices are usually set up at outdoor area, such as the patio area, garden area, campground or beach area, to give a pleasant shade for a user, wherein a conventional outdoor umbrella comprises a supporting frame with a stand having a predetermined weight and a support shaft upwardly extended from the stand, and a foldable awning supported by the supporting frame for providing a shading area.

While enjoying the shading area provided by the outdoor shading device, people may need some entertainment equipment such as MP3 player or other electronic devices to provide music, such that people can do some entertainment thing such as BBQ event, show exhibition, and so on. Besides, when going out with friends, users would always like to watch some videos such that the users usually carry a portable electronic device. However, when sharing the video with other people, an electric device must be built in some speakers. It is a hassle for people to carry such large size electric device. In addition, the screen of such electric device is not big enough for people to clearly watch the video. In other words, most of the users still prefer high quality visual and sound effects while watching video. Although different kinds of outdoor shading device being design by inventor with built-in monitor, there still exist several disadvantages for conventional shading device.

First, under the circumstances, it is inconvenient and impractical for the user to extend an electrical cord from the dwelling to the patio or garden area, much less the campground or beach area. In other words, the outdoor shading device, as the name implies, are designed for use in outdoors, existence of an electrical power source cannot be guaranteed. Thus, an accessory device which is secured on the outdoor shading device structure and adapted for providing entertainment functions is highly preferable.

Second, the built-in monitor for the first time user is very difficult to operate. Some people may need to try and error to learn how to use it. Other may need to follow the instructions. To may matter worse, an incorrect operating may cause the built-in monitor broken very easily. Thus, the outdoor AV display arrangement for outdoor shading device cannot satisfy the current needs of people who like to watch video in outdoor activities.

SUMMARY OF THE PRESENT INVENTION

A main object of the present invention is to provide a outdoor display arrangement, wherein AV display arrangement is coupled with the supporting frame of the outdoor shading device via a supporting arm and is connected with the portable electronic device by a connected unit such that the user is able to enjoy greater visual effects through watching relatively large display in comparison with the portable electric device without sacrificing a portable controlling functionality of the portable electric device.

Another object of the present invention is to provide an outdoor display arrangement, wherein the AV display can be folded to the fold situation only through adjusting the pivot controller and the detachable controller such that the steps for folding the outdoor shading device is very simple because the user is simply need to fold the outdoor shading device by folding the awning frame and the supporting arm.

Another object of the present invention is to provide an outdoor display arrangement, wherein the AV display arrangement is still operated by the interface of the portable electronic device such that it is very simple for user to operate the AV display arrangement.

Another object of the present invention is to provide an outdoor display arrangement, wherein the AV display arrangement doesn't save any data anytime during the link or whenever such that people don't need to worry about the risk of hacking secret data by other people.

Another object of the present invention is to provide an outdoor display arrangement, wherein the power supply for the AV display arrangement is self support from AC, DC power, and rechargeable batteries, and is able to provide power supply to the portable electronic device. In other words, when the portable electronic device is connected with the AV display arrangement, the portable electronic device could be in the charging mode. Thus, the user does not need to worry about the power shortage for the portable electronic device and the AV display with long hour and constant use.

Another object of the present invention is to provide an outdoor display arrangement, wherein the connection unit comprises a wireless link adapted for wirelessly linking to the portable electronic device to wirelessly transmit the audio and video signal from the portable electronic device to the AV display such that the transmitting cable may not be necessary for connection between the portable electronic device and the AV display.

Another object of the present invention is to provide an outdoor display arrangement, wherein the AV display arrangement is adapted to play video originated from a wide variety of conventional portable electronic device, such as CD players, DVD players, MP3, video players and the like for providing the maximum number of entertainment options for the user of the present invention.

Accordingly, in order to accomplish the above objects, the present invention provides an outdoor AV display arrangement for outdoor shading device, comprising:

a supporting frame;

a awning frame comprises a umbrella hub suspendedly supported by the supporting frame, a plurality of awning arms radially and outwardly extended from the umbrella hub, and an awning shade supported by the awning arms to define a shading area under the awning shade; and an outdoor AV (Audio-Video) display arrangement comprises a flat panel AV display, a screen supporting arm extended from the AV display to movably couple with the supporting frame to selectively adjust an orientation of the AV display within the shading area at an eye-level position.

These and other objectives, features, and advantages of the present invention will become apparent from the following detailed description, the accompanying drawings, and the appended claims.

DETAILED DESCRIPTION OF THE PREFERRED EMBODIMENT

Figure 1:
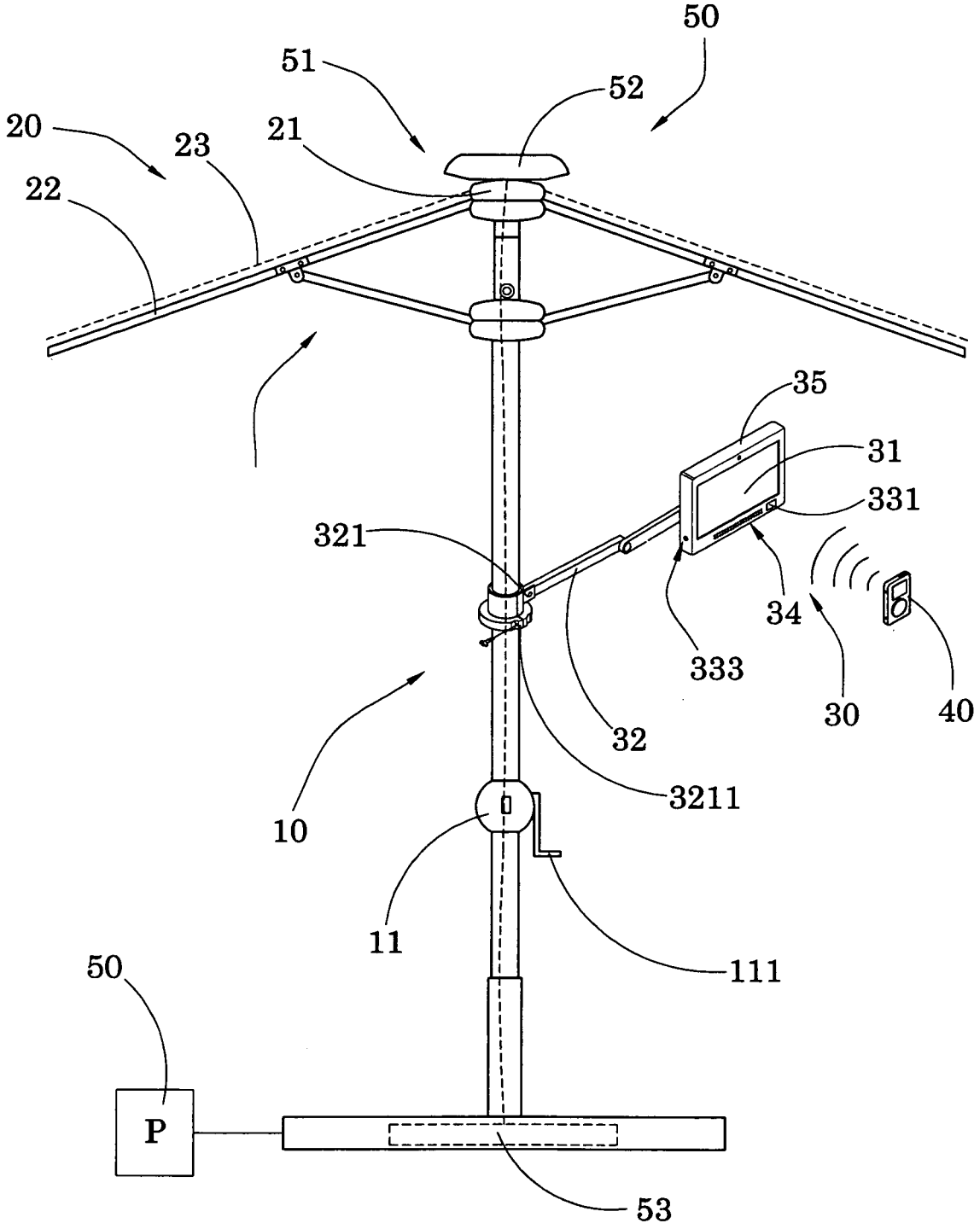
FIG. 1 is a perspective view of an outdoor AV display arrangement for an outdoor shading device according to a preferred embodiment of the present invention.

Referring to FIG. 1 of the drawings, an outdoor shading device according to a preferred embodiment of the present invention is illustrated, in which the outdoor shading device comprises a supporting frame 10, an awning frame 20, and an outdoor AV (Audio-Video) display arrangement 30.

The awning frame 20 comprises a umbrella hub 21 suspendedly supported by a supporting shaft of the supporting frame 10 as one of the elongated arms, a plurality of awning arms 22 radially and outwardly extended from the umbrella hub 21, and an awning shade 23 supported by the awning arms 22 to define a shading area under the awning shade 23. Accordingly, the supporting shaft and the awning arms 22 are the elongated arms of the outdoor shading device.

The outdoor AV (Audio-Video) display arrangement 30 comprises a flat panel AV display 31, a screen supporting arm 32 extended from the AV display 31 to movably couple with the supporting shaft of the supporting frame 10 to selectively adjust an orientation of the AV display 31 within the shading area at an eye-level position.

According to the above preferred embodiment of the present invention, the outdoor AV (Audio-Video) display arrangement 30 further comprises a connection unit 33 provided at the AV display 31 for communicatively connecting with a portable electronic device 40 for transmitting audio and video signal from the portable electronic device 40 to the AV display 30, in such a manner that the AV display 31 provides a relatively large display area in comparison with the portable electronic device 40 that instantly enables a smaller display area of the portable electronic device 40 to become a larger display area on the AV display without sacrificing a portable controlling functionality of the portable electronic device 40.

It is worth to mention that the operation of the AV display arrangement 30 is extremely simple. When the portable electronic device 40 is connected to the AV display arrangement 30, the AV display arrangement 30 is still operated by the interface of the portable electronic device 40. Because the portable electronic device 40 is owned by the user, the user is usually very familiar with it. They don't need to try and error to operate the AV display arrangement 30, or follow the complicated instructions. They just need to follow the way they usually operate it. When they want to turn off the AV display arrangement 40, they just need to disconnect the connection between the portable electronic device 40 and the AV display arrangement 30. Furthermore, the AV display arrangement 30 doesn't save any data anytime during the link or whenever. Thus, we don't need to worry about the risk of hacking secret data by other people.

Figure 2:
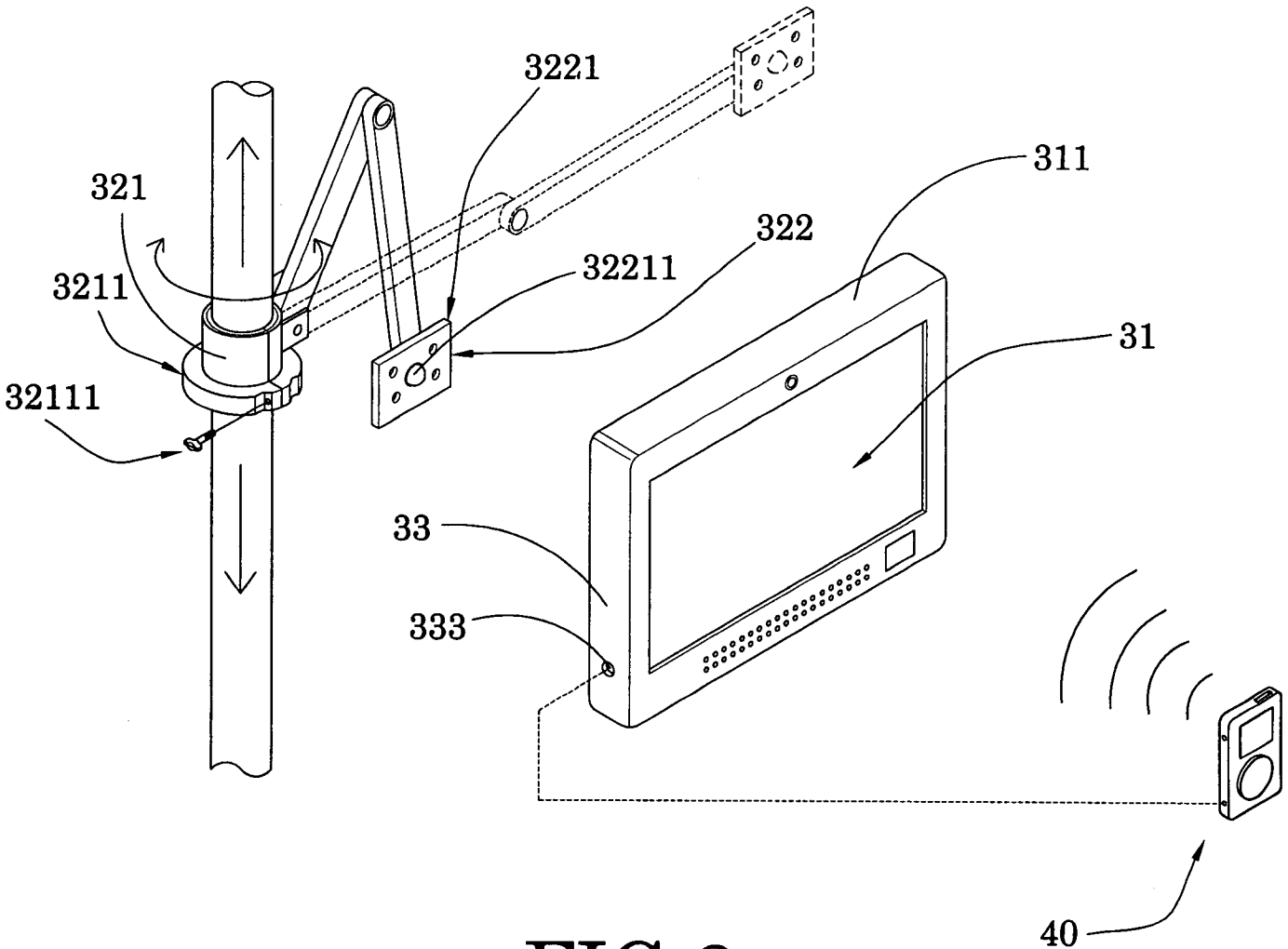
FIG. 2 is a perspective view of the connection between the AV display and the supporting arm according to the above preferred embodiment of the present invention illustrating the way to adjust the position of the AV display.

Referring to FIG. 2 of the drawings, the screen supporting arm 32 has a detachable end 321 detachably coupling at the supporting frame 10 at one of elongated arm thereof and a pivotal end 322 pivotally coupling at a rear side of the AV display 31 in such a manner that the AV display 31 is selectively adjusted its orientation via the screen supporting arm 32 and is adapted to be detached from the supporting frame 10. The user is able to change position of the AV display 31 corresponding to everyone's demand. The detachable controller 3211, comprising a hand lock 32111, is provided at the detachable end 321 of the screen supporting arm 32, wherein the user is able to loose the hand lock 32111 by hand such that the screen supporting arm 32 can be not only slid along the supporting frame 10 to adjust the elevated position of the AV display 31 with respect to the ground but also rotated around the supporting frame 10 to adjust the oriented location of the AV display 31.

Furthermore, the pivot controller 3221 comprises a ball joint 32211 provided at the pivotal end 322 of the screen supporting arm 32, wherein the user screws the AV display 31 to the pivot end 322. Thus, the AV display 31 is capability of adjusting its tilt angle via the ball joint 32211. For example, when the user prefers to adjust the eye level of the AV display 31, he or she can change the AV display 31 from a lower position to a higher position through adjusting the detachable controller 3211 of the detachable end 321. On the other hand, the pivotal end 322 provides a pivotal controller 3221 having a ball joint 32211 to control the AV display 31 direction and its tilt angle. Finally, through adjusting the pivot controller 3221 and the detachable controller 3211, the user is able to change the height, the direction, and the tilt angle of the AV display 31 they preferred. Moreover, when the user wants to fold the outdoor shading device, the AV display 31 can be folded to the fold situation through adjusting the pivot controller 3221 and the detachable controller 3211 such that the steps for folding the outdoor shading device is very simple because the user is simply need to fold the outdoor shading device by folding the awning frame 20 and the screen supporting arm 32.

Figure 4:
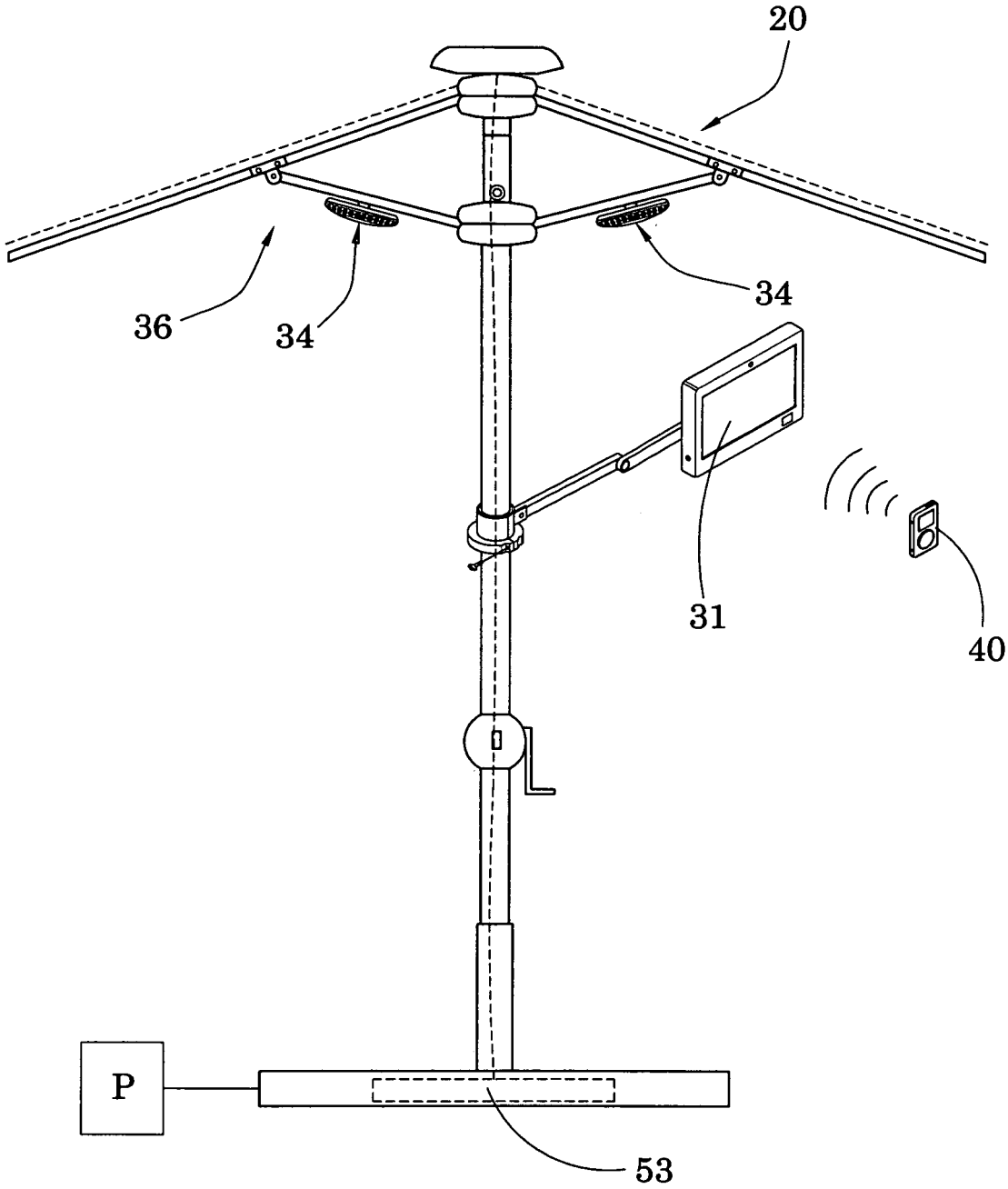
FIG. 4 is a perspective view of an outdoor AV display arrangement for the outdoor shading device according to the above preferred embodiment of the present invention illustrating the speaker being supported by the awning arms.

The AV display 31 comprises a display panel 311 for displaying video signal from the portable electronic device 40 and a speaker unit 34 for converting an audio signal to a sound signal. It is wroth to mention that the speaker unit 34 is setting up into two different positions: One is directly built-in on the display panel 311; as shown in FIG. 4, another one is set up along the boundary of the awning arms 22. Therefore, depends on the demand from the customers, the speakers 34 can built-in with the display panel 311 as a compact mode. On the other hand, in order to have louder sound and greater sound effect, the speaker can also display along the boundary of the awning frame 20.

The supporting frame 10 comprises a foldable awning frame 20 which supports the awning shade thereon and is adapted to fold between a folded position and an unfolded position, wherein at the folded position, the awning shade 23 is folded to minimize the shading area while the AV display 31 is covered by the awning shade 23, and at the unfolded position, the awning shade 23 is unfolded to maximize the shading area while the AV display 31 is suspendedly supported within the shading area. The supporting frame 10 further comprises a hand operator 11 having a hand crank 111. Through rotating the hand crank 111, both of the awing frames 20 and the awning arms 22 can be operated between the folded situation and the unfolded situation. Therefore, outdoor shading device is very easy for people to open in on the ground or close to storage in the storage room.

According to the preferred embodiment of the present invention, a power supply 50 supported by the supporting frame 10 and electrically coupled with the AV display 30. The display panel 311 further comprises a circuit transformer 35 electrically connecting with the AV display arrangement 30 for transforming an AC power from an external power source to a DC power for the AV display 30. Therefore, the AV display arrangement 30 is adapted for being powered up by an external power source for prolonged use of the AV display arrangement 30. Alternatively, the AV display arrangement 30 can also be powered by a power storage 53 for shorter usage duration. Moreover, the power supply 50 for the AV display arrangement 30 is self supported by either AC, DC power, or the power storage 53, and is able to provide power supply 50 to the portable electronic device 40. In other words, when the portable electronic device 40 is connected with the AV display arrangement 30, the portable electronic device 40 could be in the charging mode. Thus, the user does not need to worry about the power shortage for the portable electronic device 40 and the AV display 30 with long hour and constant use.

As a further alternative, the power supply 50 further comprises a solar collecting device 51 having a collecting surface 52 positioned above the shading area for collecting solar energy, wherein the power storage 53 is operatively connected to the solar collecting device 51 for storing electrical energy after being converted from the solar energy. The solar collecting device 51 further has a solar energy surface 52 supported above the awning shade 23 for facing towards the sunlight, wherein the solar energy is converted into electrical energy and is stored in the power storage 53.

Figure 3:
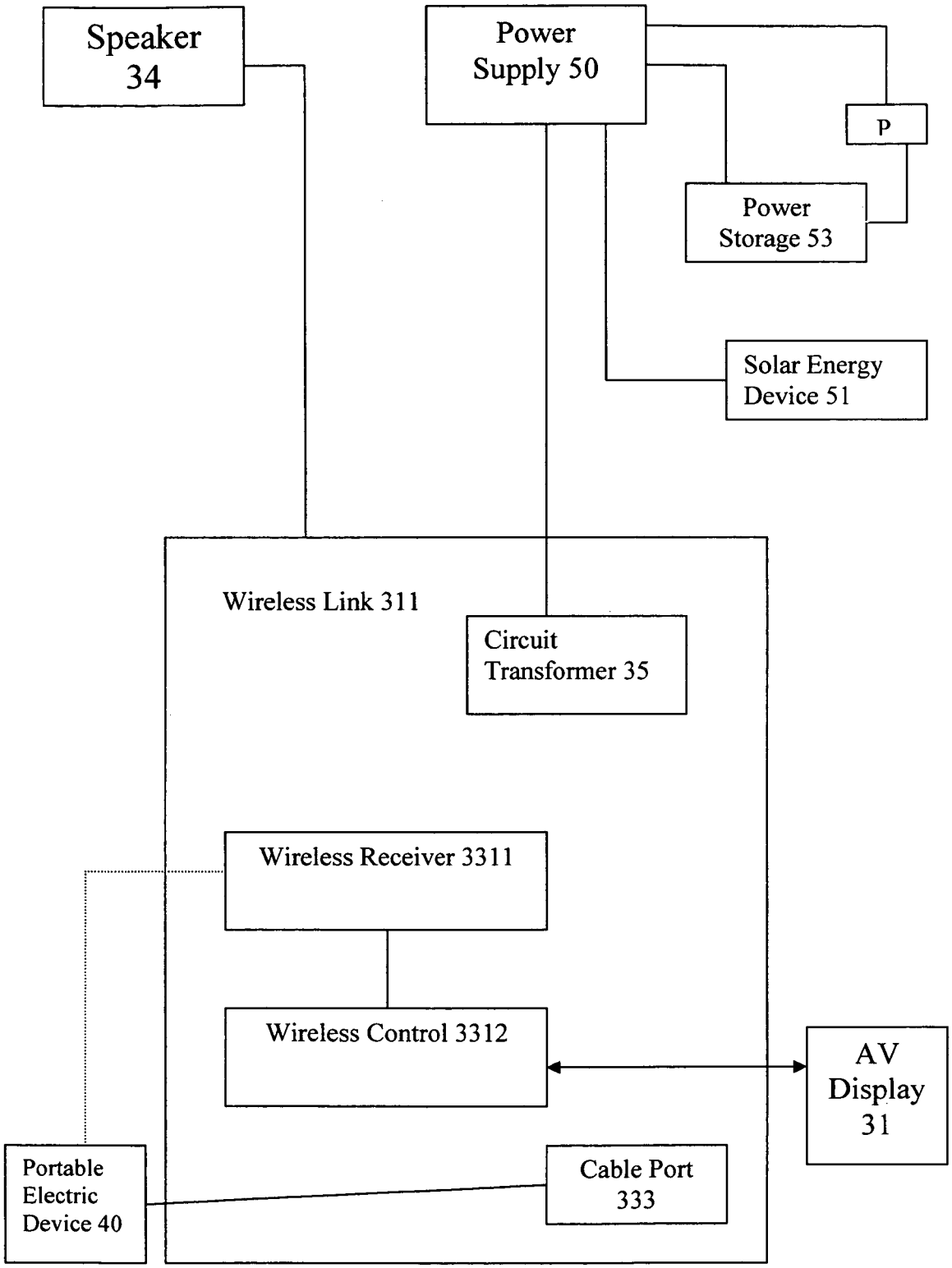
FIG. 3 is a block diagram illustrating electronic configuration of the AV display according to the above preferred embodiment of the present invention.

As shown in FIG. 3, the connection unit 33 comprises a wireless link 331 adapted for wirelessly linking to the portable electronic device 40 to wirelessly transmit the audio and video signal from the portable electronic device 40 to the AV display 30 and the speaker unit 34, wherein the wireless link 331 comprises a wireless receiver 3311 which is integrated with the AV display arrangement 30 to wirelessly transmit the audio and video signal from the portable electronic device 40 to the AV display 31. In this situation, the connection cable may not be necessary, yet it can still be used in conjunction with the wireless link 331 to cater different needs.

According to the preferred embodiment, a wireless connectivity of the wireless link is selected from the group consisting of "Bluetooth" connectivity, Infrared connectivity, and Radio Frequency connectivity. When the audio player has the compatible wireless connectivity, the wireless control 3312 is capable of wirelessly connecting with the AV display arrangement 30. For example, if the portable electronic device 40 has a built-in "Bluetooth" connecting function, the wireless control 3312 is adapted to pair with the portable electronic device 40 to transmit the video signal from the portable electronic device 40 to the AV display arrangement 30. It is worth to mention that the wireless range of the wireless control 3312 is preset with a limited range for preventing the interference of the wireless link 331.

The connection unit 33 further comprises a cable port 333 provided at a peripheral edge of the AV display 31 for communicatively connecting the portable electronic device 40 via the connection cable to transmit the audio and video signal from the portable electronic device 40 to the AV display 31 through the connection cable. Therefore, through cable transmit, the AV display arrangement 30 of the present invention is adapted to play video originated from a wide variety of conventional portable electronic device 40, such as CD players, DVD players, MP3, video players and the like for providing the maximum number of entertainment options for the user of the present invention.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An outdoor shading device, comprising:

a supporting frame;

an awning shade supported by said supporting frame to define a shading area under said awning shade; and an outdoor AV (Audio-Video) display arrangement, which comprises:

a flat panel AV display;

a screen supporting arm extended from said AV display to movably couple with said supporting frame to selectively adjust an orientation of said AV display within said shading area at an eye-level position, wherein said screen supporting arm comprises a detachable controller to be selectively coupled at said supporting frame in such a manner that said screen supporting arm is slid at said supporting frame to adjust an elevated position of said AV display and is rotated at said supporting frame to adjust an oriented location of said AV display; and a connection unit provided at said AV display for communicatively connecting with a portable electronic device and for transmitting audio and video signal from said portable electronic device to said AV display, in such a manner that said AV display provides a relatively large display area in comparison with said portable electronic device that instantly enables a smaller display area of said portable electronic device to become a larger display area on said AV display without sacrificing a portable controlling functionality of said portable electronic device, wherein once said AV display arrangement is connected with said portable electronic device, said AV display arrangement is operated by an interface of said portable electronic device while no data is saved by said AV display arrangement from said portable electronic device.

2. The outdoor shading device, as recited in claim 1, wherein said screen supporting arm has a detachable end detachably coupling at said supporting frame at one of elongated arms thereof and a pivotal end pivotally coupling at a rear side of said AV display, wherein said detachable controller is provided at said detachable end of said screen supporting arm in such a manner that said AV display is selectively adjusted its orientation via said screen supporting arm and is adapted to be detached from said supporting frame.

3. The outdoor shading device, as recited in claim 1, wherein said AV display comprises a display panel for displaying said video signal from said portable electronic device and a speaker unit for converting said audio signal to a sound signal.

4. The outdoor shading device, as recited in claim 2, wherein said AV display comprises a display panel for displaying said video signal from said portable electronic device and a speaker unit for converting said audio signal to a sound signal.

5. The outdoor shading device, as recited in claim 1, further comprising a power supply supported by said supporting frame and electrically coupled with said AV display.

6. The outdoor shading device, as recited in claim 4, further comprising a power supply supported by said supporting frame and electrically coupled with said AV display.

7. The outdoor shading device, as recited in claim 5, wherein said power supply comprises a solar collecting device having a collecting surface positioned above said shading area for collecting solar energy, and a power storage operatively connected to said solar collecting device for storing electrical energy after being converted from said solar energy.

8. The outdoor shading device, as recited in claim 6, wherein said power supply comprises a solar collecting device having a collecting surface positioned above said shading area for collecting solar energy, and a power storage operatively connected to said solar collecting device for storing electrical energy after being converted from said solar energy.

9. The outdoor shading device, as recited in claim 1, wherein said connection unit comprises a wireless link adapted for wirelessly linking to said portable electronic device to wirelessly transmit said audio and video signal from said portable electronic device to said AV display.

10. The outdoor shading device, as recited in claim 4, wherein said connection unit comprises a wireless link adapted for wirelessly linking to said portable electronic device to wirelessly transmit said audio and video signal from said portable electronic device to said AV display.

11. The outdoor shading device, as recited in claim 6, wherein said connection unit comprises a wireless link adapted for wirelessly linking to said portable electronic device to wirelessly transmit said audio and video signal from said portable electronic device to said AV display.

12. The outdoor shading device, as recited in claim 9, wherein a wireless connectivity of said wireless link is selected from the group consisting of "Bluetooth" connectivity, Infrared connectivity, and Radio Frequency connectivity.

13. The outdoor shading device, as recited in claim 10, wherein a wireless connectivity of said wireless link is selected from the group consisting of "Bluetooth" connectivity, Infrared connectivity, and Radio Frequency connectivity.

14. The outdoor shading device, as recited in claim 11, wherein a wireless connectivity of said wireless link is selected from the group consisting of "Bluetooth" connectivity, Infrared connectivity, and Radio Frequency connectivity.

15. The outdoor shading device, as recited in claim 9, wherein said connection unit further comprises a cable port provided at a peripheral edge of said AV display for communicatively connecting said portable electronic device via a connection cable to transmit said audio and video signal from said portable electronic device to said AV display through said connection cable.

16. The outdoor shading device, as recited in claim 11, wherein said connection unit further comprises a cable port provided at a peripheral edge of said AV display for communicatively connecting said portable electronic device via a connection cable to transmit said audio and video signal from said portable electronic device to said AV display through said connection cable.

17. The outdoor shading device, as recited in claim 14, wherein said connection unit further comprises a cable port provided at a peripheral edge of said AV display for communicatively connecting said portable electronic device via a connection cable to transmit said audio and video signal from said portable electronic device to said AV display through said connection cable.

18. The outdoor shading device, as recited in claim 1, wherein said supporting frame comprises a foldable awning frame which supports said awning shade thereon and is adapted to fold between a folded position and an unfolded position, wherein at said folded position, said awning shade is folded to minimize said shading area while said AV display is covered by said awning shade, and at said unfolded position, said awning shade is unfolded to maximize said shading area while said AV display is suspendedly supported within said shading area.

19. The outdoor shading device, as recited in claim 6, wherein said supporting frame comprises a foldable awning frame which supports said awning shade thereon and is adapted to fold between a folded position and an unfolded position, wherein at said folded position, said awning shade is folded to minimize said shading area while said AV display is covered by said awning shade, and at said unfolded position, said awning shade is unfolded to maximize said shading area while said AV display is suspendedly supported within said shading area.

20. The outdoor shading device, as recited in claim 17, wherein said supporting frame comprises a foldable awning frame which supports said awning shade thereon and is adapted to fold between a folded position and an unfolded position, wherein at said folded position, said awning shade is folded to minimize said shading area while said AV display is covered by said awning shade, and at said unfolded position, said awning shade is unfolded to maximize said shading area while said AV display is suspendedly supported within said shading area.

* * * * *